US005774116A

United States Patent [19]

Pötsch

[11] Patent Number: 5,774,116

[45] Date of Patent: Jun. 30, 1998

[54] ELECTRIC FUNCTIONAL UNIT AND CATHODE RAY TUBE VISUAL DISPLAY UNIT

[75] Inventor: Edmund Pötsch, Königshrunn, Germany

[73] Assignee: Siemens Nixdorf Informationssysteme Aktiengesellschaft, Paderborn, Germany

[21] Appl. No.: 738,731

[22] Filed: Oct. 28, 1996

Related U.S. Application Data

[63] Continuation of Ser. No. 641,205, Apr. 30, 1996, abandoned, which is a continuation of Ser. No. 256,992, filed as PCT/DE93/00056, Jan. 25, 1993, published as WO93/15495, Aug. 5, 1993, abandoned.

[30] Foreign Application Priority Data

| | | | |
|---|---|---|---|
| Jan. 31, 1992 | [DE] | Germany | 42 02 793.4 |
| Jan. 31, 1992 | [DE] | Germany | 42 02 794.2 |
| Jan. 31, 1992 | [DE] | Germany | 9201166 U |

[51] Int. Cl.[6] ..... G09G 5/00

[52] U.S. Cl. ..... 345/211; 345/212

[58] Field of Search ..... 345/211–214; 348/730; 364/200; 395/184.01, 82.21, 750

[56] References Cited

U.S. PATENT DOCUMENTS

| | | | |
|---|---|---|---|
| 3,453,601 | 7/1969 | Bogert et al. . | |
| 3,941,989 | 3/1976 | McLaughlin et al. | 345/213 |
| 3,955,185 | 5/1976 | Nishimura | 345/211 |
| 4,716,463 | 12/1987 | Stacy et al. . | |
| 4,722,005 | 1/1988 | Ledenbach | 348/173 |
| 4,811,200 | 3/1989 | Wagner et al. . | |
| 4,823,121 | 4/1989 | Sakamoto et al. | 345/211 |
| 4,922,448 | 5/1990 | Kunieda et al. | 345/1 |
| 5,167,024 | 11/1992 | Smith et al. | 395/750 |
| 5,245,312 | 9/1993 | Kiuchi et al. | 340/309.4 |
| 5,375,245 | 12/1994 | Solhjell et al. | 345/212 |
| 5,384,579 | 1/1995 | Nakasuji et al. | 345/212 X |
| 5,404,149 | 4/1995 | Joliey | 345/212 |

FOREIGN PATENT DOCUMENTS

| | | |
|---|---|---|
| 64-2112 | 1/1989 | Japan . |
| 64-33586 | 2/1989 | Japan . |
| 2-304610 | 12/1990 | Japan . |

*Primary Examiner*—Amare Mengistu
*Attorney, Agent, or Firm*—Hill & Simpson

[57] ABSTRACT

In order to control an energy-saving state of a cathode screen (M) by a control device (PC) connected thereto via a standard interface (SS) for its operation without the individual devices' being restricted to use in an arrangement with instruments tuned to one another relatively to the control of the energy-saving state, there are means for transmission, independent of the function of the standard interface (SS), of information (SB) controlling the energy-saving state of the cathode screen (M) in coded form between the control device and the cathode screen (PC and M).

4 Claims, 1 Drawing Sheet

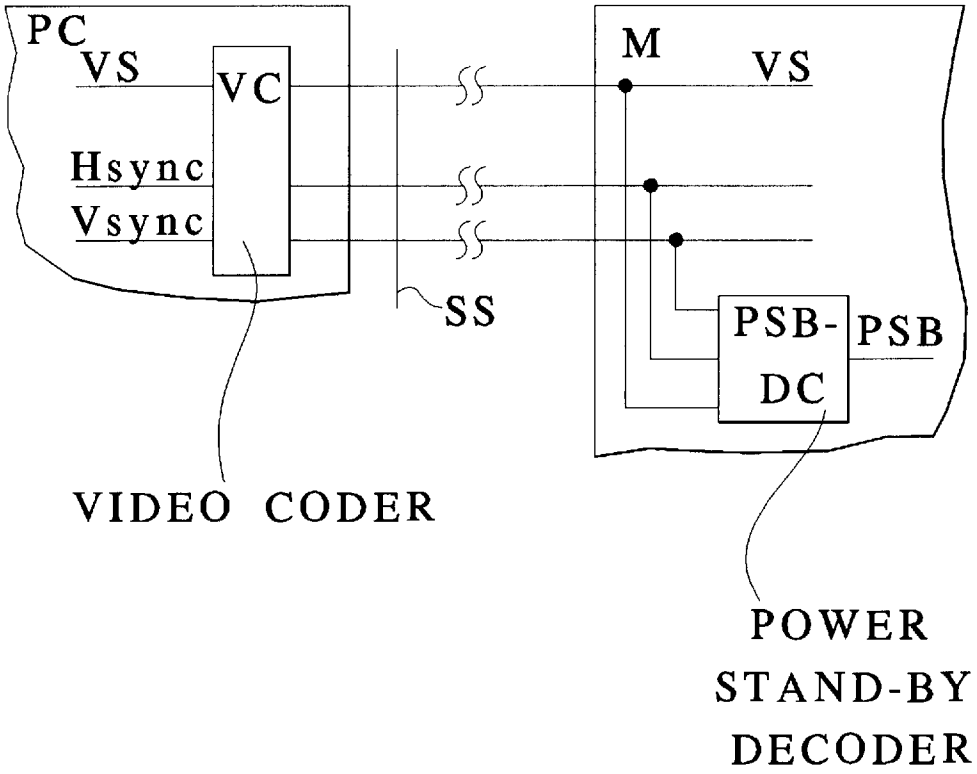
PC
VS
VC
Hsync
Vsync
SS
M
VS
PSB-
DC
PSB
VIDEO CODER
POWER
STAND-BY
DECODER

ELECTRIC FUNCTIONAL UNIT AND CATHODE RAY TUBE VISUAL DISPLAY UNIT

This is a continuation of application Ser. No. 08/641,205, filed Apr. 30, 1996, now abandoned which is a continuation of application Ser. 08/256,992 filed Jul. 29, 1994, now abandoned, which is A371 of PCT/DE93/00056 filed Jan. 25, 1993, published as WO93/15495, Aug. 5, 1993.

BACKGROUND OF THE INVENTION

1. Field of the Invention

The invention relates generally to video systems and more specifically; to an electric functional unit and a cathode-ray tube visual display unit according Cathode-ray tube visual display units convert energy into heat which is unused. In particular, cathode-ray tube visual display units with a color screen have, for example, a power loss of about 100 watts. In when used with an electric functional unit as a control device, such as for example a personal computer, the cathode-ray tube visual display units known here as monitors usually run in continuous operation, although the actual time of use makes up only a fraction of the operating time.

There are admittedly known visual display units of the Nixdorf company, for example BA 80, which switch into an energy-saving state when a monitor is out of action for lengthy periods. Here, however, the monitor is firmly connected to the control device, so that it is possible by virtue of the precise matching of the devices to each other for example for the synchronizing signals of the monitor to' be switched off without any problem.

In the case of a so-called "open arrangement", that is to say in an arrangement with a control device and a cathode-ray tube visual display unit as individual devices, such a control cannot be carried out, because otherwise monitors not belonging to the arrangement would produce an unsynchronized flickering image. However, monitors should be able to operate on every system envisaged for them without adversely affecting the basic function of said system. Similarly, the control device should be able to operate each monitor in its basic function.

The document EP-A-0 456 923 discloses a screen display system with a computer unit in the form of a personal computer and a cathode-ray tube visual display unit. The screen display system has in addition to an interface for supplying the cathode-ray tube visual display unit for its basic function with corresponding signals an additional serial interface for coded signals between the computer unit and the cathode-ray tube visual display unit. The system is constructed in such a way that in the cathode-ray tube visual display unit there is provided a read-only memory for device-specific parameters, such as for example resolution and geometry of the screen or activation times. When switching on the system, these parameters are read out from the computer unit and the computer unit sets itself to the connected type of cathode-ray tube visual display unit. There is no mention of the problem of putting the display unit in a predeterminable energy-saving state by the computer unit via the interface which supplies the cathode-ray tube visual display unit with appropriate signals for its space function.

U.S. Pat. No. 5,059,961 discloses a computer system in which a signal is generated if no further data are entered into the computer system. This situation means that no one is working on the computer system. The signal is-relayed to a time monitoring unit and starts the latter. After a predetermined period of, time, the time monitoring device generates a further signal, by which the horizontal and vertical synchronizing signal for a cathode-ray tube visual display unit is blocked. All other electrical functions remain unchanged. By the blocking of the synchronizing signals, the cathode-ray tube visual display unit is blanked. As soon as data are entered into the computer system again, the synchronizing signals are released and a screen display reappears. The specified measures are intended to avoid burning of the inner surface of the picture tube caused by the presence of a static image during phases in which no one is working on the computer system. There is no mention of the problem of putting the cathode-ray tube visual display unit into a predeterminable energy-saving state by sending out a corresponding message in coded form to the cathode-ray tube visual display unit via the interface which supplies the cathode-ray tube visual display unit with appropriate signals for its basic function.

Patent Abstracts of Japan, JP-A-1 269 979 discloses a device arrangement having-a cathode-ray tube visual display unit with a queuing condition function and a control device supplying the cathode-ray tube visual display unit with appropriate signals for its basic mode of operation via line connections of a standard interface. The device arrangement comprises, in a keyboard signal line, a signal evaulation circuit which switches off the power supply of the cathode-ray tube, visual display unit by means of a power supply cut-out switch if the signals on the keyboard signal line do not alter for a predetermined period of time. Consequently, the cathode-ray tube visual display unit does admittedly assume a state similar to an energy-saving state. However, owing to increased switching on/off cycles due to the respective total shut-down of the power supply, the modules of the cathode-ray tube visual display unit are prematurely worn, as a result of which the lifetime of the device is shortened. Thus, this is not an energy-saving control which preserves components. In addition if the tube heating is maintained, there is the risk of "cathode poisoning".

It is known from German Utility Model G 90 12 582.7 U and the document GB-A-2 007 471 for to control a queuing condition function of the cathoderay tube visual display unit by using the line connections, in particular the video signal line, of a standard interface for operating the cathode-ray tube visual display unit. In this case, however, only a blanking of the cathode-ray tube is possible, as a result of which burning is indeed prevented, but there is no preservation of the components by power reduction of as many components as possible or shut-down owing to the otherwise full operating state of the cathode-ray tube visual display unit. There is no mention of the problem of putting the cathode-ray tube visual display unit into a predetermined energy-saving state by sending out a coded message to the cathode-ray tube visual display unit via the interface which supplies the cathode-ray tube visual display unit with appropriate signals for its basic function.

It is known from the document DE-C-3 8 620 for the blanking of a cathode-ray tube visual display unit to provide a proximity switch which permits controlling of a queuing condition function independently of the actual controlling of the cathode-ray tube visual display unit. Owing to the otherwise full operating state of the cathode-ray tube visual display unit, however, here too there is again no preservation of the components by power reduction or shut-down.

SUMMARY OF THE INVENTION

The object of the invention is to provide an electric functional unit and a cathode-ray tube visual display unit having the possibility of controlling on the part of the control device at least a first predetermined energy-saving state of the cathode-ray tube visual display unit preserving as many components as possible by sending out an appropriate message to the cathode-ray tube visual display unit by power reduction or shut-down, without thereby restricting the use of the individual devices to an arrangement in which both the control device can control the energy-saving state of the cathode-ray tube visual display unit and the cathode-ray tube visual display unit is controllable with respect to an energy-saving state.

This object is achieved according to the invention by an electric functional unit (EFU) and cathode-ray tube visual display unit (CRT VDU) apparatus, having an electric functional unit (EFU) having means for generating a coded message, the coded message having at least two types of control information including a predetermined energy-saving state, a cathode-ray tube visual display unit (CRT VDU) having means for evaluating the coded message received from the EFU, a standard interface having connection lines for supplying the CRT VDU with basic function signals from the EFU, the EFU and the CRT VDU each having respective connection points to connect the connection lines of the standard interface, and matched means for transmitting the coded message including the predetermined energy-saving state from the EFU to the CRT VDU to put the CRT VDU into the energy-saving state.

By putting the cathode-ray tube visual display unit into an energy-saving state by means of a coded message on the part of the electric functional unit to the cathode-ray tube visual display unit, there is the possibility of switching off after a first period of time only those parts of the cathode-ray tube visual display unit which are not required for a quick restart. Consequently, energy-saving operation which preserves components is possible. After a second period of time, the cathode-ray tube visual display unit can then be switched off completely, whereby a 100% energy saving is achieved.

Since transmission of a message for controlling an energy-saving state of the cathode-ray tube visual display unit which is independent of the function of the standard interface is possible, the individual devices are not respectively dependent on a correspondingly conversely designed other device. The basic functions of the individual devices are provided for irrespective of their mutual design with respect to the possibility of controlling or accomplishing an energy-saving state. If the devices are not correspondingly conversely designed, it is simply that either the cathode-ray tube visual display unit cannot receive or evaluate the message for controlling the energy-saving state or that the control device cannot transmit such a message in the first place. Although the advantage of the energy-saving state cannot be used in these cases, the individual devices as such remain universally usable.

In particular, it is advantageous if the control device, has a device for switching off the function of the transmission of a message controlling the energy-saving state of the cathode-ray tube visual display unit, because then cathode-ray tube visual display units can be operated reliably, free from any disruptions, without the energy-saving state, or without a corresponding configuration for controlling the energy-saving state.

An exemplary embodiment of the invention is explained in more detail below with reference to a drawing.

BRIEF DESCRIPTION OF THE DRAWINGS

The figure shows a control device PC and a monitor of the present invention interconnected via a standard interface SS.

DETAILED DESCRIPTION OF THE PREFERRED EMBODIMENTS

The monitor M is supplied with appropriate signals for its basic function via the standard interface SS. The standard interface SS shown has three line connections, of which two are responsible for the transmission of synchronizing signals Hsync, Vsync in the X direction and Y direction, respectively, of the monitor M and the third is responsible for the transmission of a video signal VS. However, any -other desired standard interfaces are conceivable. For example, those for the operation of monitors with a color screen and analog input. In this case, the standard interface would have, for example, three line connections for a video signal of a predetermined color each. In the case of those with a digital input, the number of video signal lines would, for example, correspond to the number of possible color/brightness stages of the image to be generated. For controlling the energy-saving state-of the monitor M a message in coded form is transmitted on the line connections of the standard interface SS. Apart from the line connections of the standard interface SS, no further line connections are needed.

For transmitting the message controlling an energy-saving state of the monitor M, the control device PC has a video coder VC, which codes the message and integrates it into the video signal. For example, a video signal $\geqq 0$ is transmitted during the horizontal and/or vertical flyback phase of the screen beam. In this case, the message generating function should be optionally selectable by the user, since otherwise flyback lines may become visible under certain circumstances if monitors of a different type are used. However, this effect can be reduced by special selection of the level and of the color.

The monitor M has a so-called "power stand-bye" decoder PSB-DC, which filters out from the transmitted signals a message PSB decisive for controlling the energy-saving state.

The PSB decoder PSB-DC can also be made to activate a "power stand-by state" by complete or partial switching off of the sync signals. It is advantageous at least in this case if the control unit PC has a device for switching off the function controlling -the PSB decoder which can be operated freely selectively, for example by a user of the control device PC. This could take place, for example, by so-called setup menu switches.

Although other modifications and changes may be suggested by those skilled in the art, it is the intention of the inventor to embody within the patent warranted hereon all changes and modifications as reasonably and properly come within the scope of his contribution to the art.

I claim:

1. A method for saving energy in a control device and monitor system comprising the steps of:

connecting a standard interface having signal lines between a control device and a monitor, and having assigned thereto, a matched means for providing generation, transmission and evaluation of a coded message, wherein said matched means comprises device elements for generation of said message arranged in said control device and device elements for evaluation of said message arranged in said monitor;

generating and evaluating a coded message using said device elements to set said monitor into a predetermined energy-saving state resulting in said monitor initially assuming a first predetermined energy-saving state and at a later time assuming at least a second predetermined energy-saving state.

2. In a personal computer and monitor system having a personal computer connected via standard interface to a monitor, said standard interface supplying basic operating signals from said personal computer to said monitor, said monitor being operable at least two energy-saving states, the improvement comprising:

said standard interface having a personal computer interface side including video coder means for generating and transmitting a coded message via said interface commanding said monitor to enter into a first said at least two energy-saving states at a first point in time and into at least a second of said energy-saving states, different from said first energy-saving state, at a subsequent point in time, said video coder means being serially connected in said personal computer interface side; and said standard interface having a monitor interface side including power standby decoder means for receiving and evaluating said coded message and for producing a power standby decoder output for causing, said monitor to assume said first energy-saving state and to assume said second energy-saving state respectively at said first and subsequent points in time, said power standby decoder means being connected in parallel with said monitor interface side.

3. The energy-saving control device and monitor system of claim 2, wherein said control device further comprises:

means for switching off the transmission of said coded message to put said monitor in said energy-saving state.

4. The energy-saving control device and monitor system of claim 3, wherein said means for switching off the transmission of said coded message to put said monitor in said energy-saving state is selectively operable by a user.

* * * * *